US005836058A

United States Patent [19]

Cullum

[11] Patent Number: 5,836,058

[45] Date of Patent: Nov. 17, 1998

[54] SAFETY RELEASE ZIPPER

[76] Inventor: Edward J. Cullum, 23 Azalea Ct., Plainview, N.Y. 11803

[21] Appl. No.: 871,251

[22] Filed: Jun. 9, 1997

[51] Int. Cl.[6] ..... A44B 19/00

[52] U.S. Cl. ..... 24/401; 24/409; 24/411; 24/418

[58] Field of Search ..... 24/409, 401, 410, 24/411, 418, 419

[56] References Cited

U.S. PATENT DOCUMENTS

| | | | |
|---|---|---|---|
| 2,371,591 | 3/1945 | Cizek | 24/410 |
| 2,493,308 | 1/1950 | Morin | 24/411 |
| 2,600,905 | 6/1952 | Morin | 24/409 |
| 2,616,141 | 11/1952 | Morin | 24/418 |
| 4,231,138 | 11/1980 | Moertel | 24/401 |

*Primary Examiner*—Victor N. Sakran

[57] ABSTRACT

A safety release zipper including two opposing side portions securable to two opposing sides of a garment to be closed together. Two lengths of interlocking teeth are secured to and extend inwardly from the two opposing side portions. The teeth have a triangular configuration including a base portion, angled side portions and an apex portion. A sliding channel having an interior block is slidably coupled with the two lengths of interlocking teeth. The sliding channel slides along the lengths of interlocking teeth to facilitate the engagement and disengagement thereof. A pivotal handle is coupled with the sliding channel.

1 Claim, 1 Drawing Sheet

SAFETY RELEASE ZIPPER

BACKGROUND OF THE INVENTION

1. Field of the Invention

The present invention relates to a safety release zipper and more particularly pertains to separating due to pressures placed on a garment with a safety release zipper.

2. Description of the Prior Art

The use of slide fasteners is known in the prior art. More specifically, slide fasteners heretofore devised and utilized for the purpose of facilitating removal of a garment are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,964,136 to Panzeri discloses sliding clasp fasteners. U.S. Pat. No. 5,272,793 to Wilk discloses a zipper-type closure device. U.S. Pat. No. 4,987,658 to Horita discloses a slide fastener. U.S. Pat. No. 4,976,016 to Takabatake discloses a separable slide fastener. U.S. Pat. No. 4,610,057 to Akashi discloses a separable slide fastener. U.S. Pat. No. Des.331,892 to Semons discloses the ornamental design for a slide fastener assembly.

While these devices fulfill their respective, particular objective and requirements, the aforementioned patents do not describe a safety release zipper for separating due to pressures placed on a garment.

In this respect, the safety release zipper according to the present invention substantially departs from the conventional concepts and designs of the prior art, and in doing so provides an apparatus primarily developed for the purpose of separating due to pressures placed on a garment.

Therefore, it can be appreciated that there exists a continuing need for new and improved safety release zipper which can be used for separating due to pressures placed on a garment. In this regard, the present invention substantially fulfills this need.

SUMMARY OF THE INVENTION

In the view of the foregoing disadvantages inherent in the known types of slide fasteners now present in the prior art, the present invention provides an improved safety release zipper. As such, the general purpose of the present invention, which will be described subsequently in greater detail, is to provide a new and improved safety release zipper and method which has all the advantages of the prior art and none of the disadvantages.

To attain this, the present invention essentially comprises two opposing side portions securable to two opposing sides of a garment to be closed together. Two lengths of interlocking teeth are secured to and extend inwardly from the two opposing side portions. The teeth have a triangular configuration including a base portion, angled side portions of a predetermined angle and an apex portion. The apex portion is blunted to preclude cutting. A sliding channel having an interior block is slidably coupled with the two lengths of interlocking teeth. The sliding channel slides along the lengths of interlocking teeth to facilitate the engagement and disengagement thereof. A pivotal handle is coupled with the sliding channel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved safety release zipper which has all the advantages of the prior art slide fasteners and none of the disadvantages.

It is another object of the present invention to provide a new and improved safety release zipper which may be easily and efficiently manufactured and marketed.

It is a further object of the present invention to provide a new and improved safety release zipper which is of durable and reliable construction.

An even further object of the present invention is to provide a new and improved safety release zipper which is susceptible of a low cost of manufacture with regard to both materials and labor, and which accordingly is then susceptible of low prices of sale to the consuming public, thereby making such a safety release zipper economically available to the buying public.

Even still another object of the present invention is to provide a new and improved safety release zipper for separating due to pressures placed on a garment.

Lastly, it is an object of the present invention to provide a new and improved safety release zipper including two opposing side portions securable to two opposing sides of a garment to be closed together. Two lengths of interlocking teeth are secured to and extend inwardly from the two opposing side portions. The teeth have a triangular configuration including a base portion, angled side portions and an apex portion. A sliding channel having an interior block is slidably coupled with the two lengths of interlocking teeth. The sliding channel slides along the lengths of interlocking teeth to facilitate the engagement and disengagement thereof. A pivotal handle is coupled with the sliding channel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
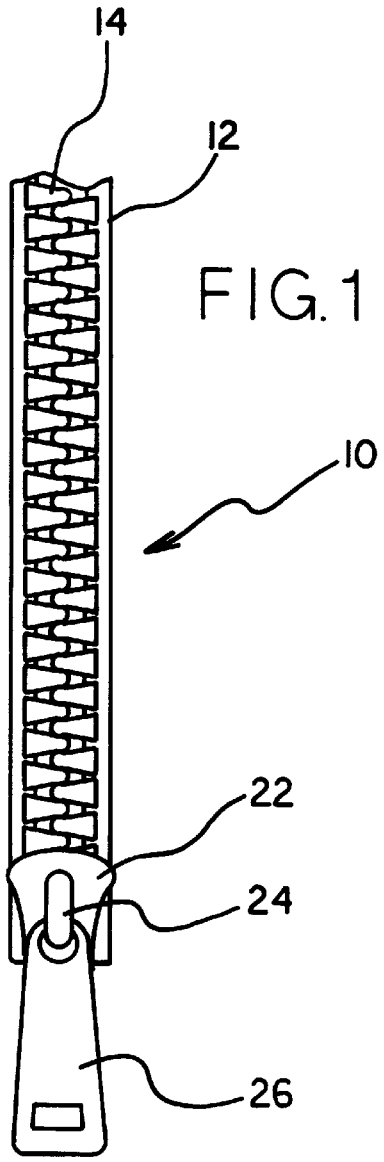
FIG. 1 is a front view of the preferred embodiment of the safety release zipper constructed in accordance with the principles of the present invention.
Figure 2:
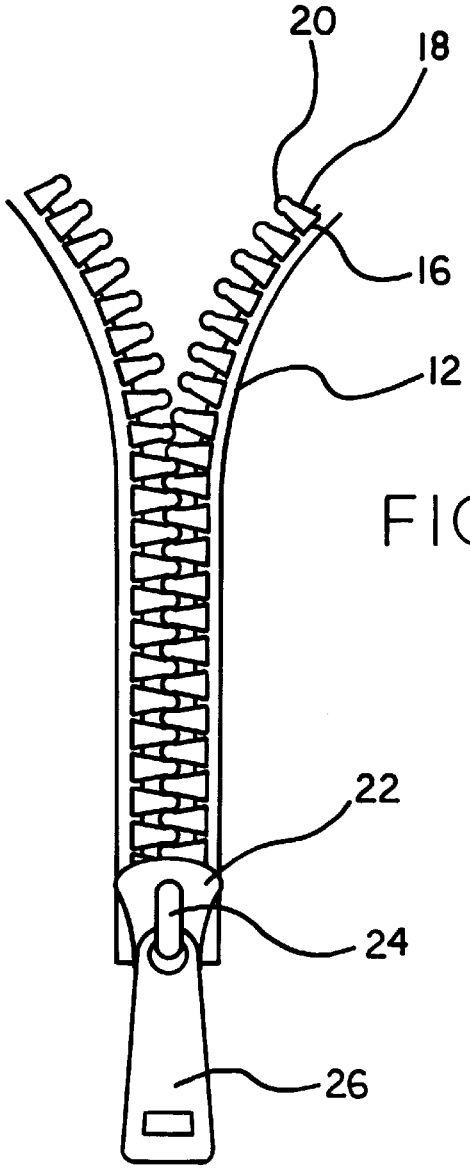
FIG. 2 is a front view of the present invention illustrated in a slightly open orientation.

With reference now to the drawings, and in particular, to FIGS. 1 and 2 thereof, the preferred embodiment of the new and improved safety release zipper embodying the principles and concepts of the present invention and generally designated by the preference number 10 will be described.

Specifically, it will be noted in the various Figures that the device relates to a safety release zipper for separating due to pressures placed on a garment. In its broadest context, the device consists of two opposing side portions, two lengths of interlocking teeth, a sliding channel having an interior block and a pivotal handle. Such components are individually configured and correlated with respect to each other so as to attain the desired objective.

The two opposing side portions 12 are securable to two opposing sides of a garment to be closed together. Such garments are trousers, shirts, jackets or the like.

The two lengths of interlocking teeth 14 are secured to and extend inwardly from the two opposing side portions 12. The teeth 14 have a triangular configuration including a base portion 16, angled side portions 18 of a predetermined angle and an apex portion 20. The apex portion 20 is blunted to preclude cutting. The angle of the angled side portions 18 will vary to accommodate the degree of release pressure desired. The greater the angle of the side portions 18, the easier the interlocking teeth 14 will become disengaged from pressure. Ideally, an infant or small child will have a zipper that has easily disengaged teeth 14 on items such as coats and shirts to prevent any possible choking that might occur if their clothes became snagged and their coat or shirt became wrapped around their neck.

The sliding channel 22 having an interior block 24 is slidably coupled with the two lengths of interlocking teeth 14. The sliding channel 22 slides along the lengths of interlocking teeth 14 to facilitate the engagement and disengagement thereof.

A pivotal handle 26 is coupled with the sliding channel. The handle 26 is provided to aid in the manipulation of the zipper.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected Letters Patent of the United States is as follows:

1. A safety release zipper for allowing separation due to pressures placed on a garment comprising, in combination:

two opposing side portions securable to two opposing sides of a garment to be closed together;

two lengths of interlocking teeth secured to and extending inwardly from the two opposing side portions, the teeth having a triangular configuration including a base portion, angled side portions of a predetermined angle and an apex portion, the apex portion being blunted to preclude cutting, the angled side portions of each of the teeth being substantially linear and without indentations, the linear side portions of the teeth functioning to enable the two length of interlocking teeth to be manually pulled apart;

a sliding channel having an interior block slidably coupling with the two lengths of interlocking teeth, the sliding channel sliding along the lengths of interlocking teeth to facilitate the engagement and disengagement thereof;

a pivotal handle coupled with the sliding channel.

* * * * *